US006772692B2

(12) United States Patent
Baginski et al.

(10) Patent No.: US 6,772,692 B2
(45) Date of Patent: Aug. 10, 2004

(54) ELECTRO-EXPLOSIVE DEVICE WITH LAMINATE BRIDGE

(75) Inventors: Thomas A. Baginski, Auburn, AL (US); Todd S. Parker, Hollister, CA (US); Wm. David Fahey, Cupertino, CA (US)

(73) Assignees: LifeSparc, Inc., Hollister, CA (US); Auburn University, Auburn, AL (US)

( * ) Notice: Subject to any disclaimer, the term of this patent is extended or adjusted under 35 U.S.C. 154(b) by 0 days.

(21) Appl. No.: 10/418,647

(22) Filed: Apr. 18, 2003

(65) Prior Publication Data

US 2003/0192445 A1 Oct. 16, 2003

Related U.S. Application Data

(63) Continuation of application No. 09/656,523, filed on Sep. 7, 2000, now abandoned.
(60) Provisional application No. 60/206,864, filed on May 24, 2000.

(51) Int. Cl.[7] ..... F42C 19/12
(52) U.S. Cl. ..... 102/202.7; 202/206
(58) Field of Search ..... 102/202.5, 202.7, 102/206, 215

(56) References Cited

U.S. PATENT DOCUMENTS

| | | | | |
|---|---|---|---|---|
| 2,821,139 A | 1/1958 | Apstein et al. | ..... | 102/70.2 |
| 3,211,096 A | 10/1965 | Forney et al. | ..... | 102/28 |
| 3,420,174 A | 1/1969 | Potter | ..... | 102/28 |
| 3,572,247 A | 3/1971 | Warshall | ..... | 102/28 |
| 3,640,224 A | 2/1972 | Petrick et al. | ..... | 102/28 |
| 3,669,022 A | 6/1972 | Dahn et al. | ..... | 102/28 EB |
| 3,682,096 A | 8/1972 | Lüdke et al. | ..... | 102/28 R |
| 3,735,705 A | 5/1973 | Hudson, Jr. et al. | ..... | 102/28 R |
| 3,753,403 A | 8/1973 | Menichelli | ..... | 102/28 R |
| 3,831,523 A | 8/1974 | Thomas et al. | ..... | 102/28 R |
| 3,882,324 A | 5/1975 | Smolker et al. | ..... | 307/202 A |
| 3,974,424 A | 8/1976 | Lee | ..... | 317/80 |

(List continued on next page.)

FOREIGN PATENT DOCUMENTS

| | | |
|---|---|---|
| CA | 581316 | 8/1959 |
| DE | 39 18 408 A1 | 12/1990 |

(List continued on next page.)

OTHER PUBLICATIONS

Baginski and Hodel, "The semiconductor junction ingniter: a novel RF and ESD insensitive electro–explosive device", *IEEE Trans. Ind. Appl.*, 29(2), 412–418 (1993).

*Primary Examiner*—Michael J. Carone
*Assistant Examiner*—Troy Chambers
(74) *Attorney, Agent, or Firm*—Heller Ehrman White & McAuliffe LLP

(57) ABSTRACT

A semiconductor bridge (SCB) device. In one embodiment, the SCB device includes a laminate layer on top of an insulating material, wherein the laminate layer comprises a series of layers of at least two reactive materials, and wherein the laminate layer comprises two relatively large sections that substantially cover the surface area of the insulating material, and a bridge section joining the two relatively large sections. At least one conductive contact pad is coupled to at least one of the series of layers, wherein a predetermined current through the conductive contact pad causes the bridge section to initiate a reaction in which the laminate layer is involved. In one embodiment, the SCB device includes an integrated diode formed by an interface of the insulating material with another material, such as a metal.

36 Claims, 4 Drawing Sheets

U.S. PATENT DOCUMENTS

| | | | | |
|---|---|---|---|---|
| 4,061,088 | A | 12/1977 | Ueda | 102/28 R |
| 4,271,453 | A | 6/1981 | Yajima et al. | 361/248 |
| 4,304,184 | A | 12/1981 | Jones | 102/202.13 |
| 4,378,738 | A | 4/1983 | Proctor et al. | 102/202.7 |
| 4,422,381 | A | 12/1983 | Barrett | 102/202.2 |
| 4,428,292 | A | 1/1984 | Riggs | 102/202.7 |
| 4,517,895 | A | 5/1985 | Rucker | 102/202.2 |
| 4,586,435 | A | 5/1986 | Bock | 102/202.5 |
| 4,592,280 | A | 6/1986 | Shores | 102/202.2 |
| 4,690,056 | A | 9/1987 | Brede et al. | 102/202.2 |
| 4,708,060 | A | 11/1987 | Bickes, Jr. et al. | 102/202.7 |
| 4,729,315 | A | 3/1988 | Proffit et al. | 102/202.9 |
| 4,779,532 | A | 10/1988 | Riley et al. | 102/202.2 |
| 4,819,560 | A | 4/1989 | Patz et al. | 102/202.5 |
| 4,840,122 | A | 6/1989 | Nerheim | 102/202.5 |
| 4,893,563 | A | 1/1990 | Baginski | 102/202.2 |
| 4,944,224 | A | 7/1990 | Fiedler et al. | 102/202.2 |
| 4,967,665 | A | 11/1990 | Baginski | 102/202.2 |
| 4,976,200 | A | 12/1990 | Benson et al. | 102/202.7 |
| 4,977,105 | A | 12/1990 | Okamoto et al. | 437/190 |
| 5,085,146 | A | 2/1992 | Baginski | 102/202.5 |
| 5,088,412 | A | 2/1992 | Patrichi | 102/202.13 |
| 5,088,413 | A | 2/1992 | Huber et al. | 102/202.5 |
| 5,099,762 | A | 3/1992 | Drapala | 102/202.1 |
| 5,179,248 | A | 1/1993 | Hartman et al. | 102/202.4 |
| 5,309,841 | A | 5/1994 | Hartman et al. | 102/202.4 |
| 5,370,054 | A | 12/1994 | Reams et al. | 102/202.5 |
| 5,439,847 | A | 8/1995 | Chittipeddi et al. | 437/192 |
| 5,448,114 | A | 9/1995 | Kondoh et al. | 257/778 |
| 5,454,320 | A | 10/1995 | Hilden et al. | 102/202.7 |
| 5,648,634 | A | 7/1997 | Avory et al. | 102/202.1 |
| 5,672,841 | A | 9/1997 | Monk et al. | 102/202.4 |
| 5,763,814 | A | 6/1998 | Avory et al. | 102/202.7 |
| 5,798,475 | A | 8/1998 | Reynes et al. | 102/202.5 |
| 5,831,203 | A | 11/1998 | Ewick | 102/202.5 |
| 5,847,309 | A | 12/1998 | Baginski | 102/202.2 |
| 5,905,226 | A | 5/1999 | Baginski | 102/202.2 |
| 5,912,427 | A | 6/1999 | Willis et al. | 102/202.8 |
| 5,992,326 | A | 11/1999 | Martinez-Tovar et al. | 102/202.4 |
| 6,054,760 | A | 4/2000 | Martinez-Tovar et al. | 257/692 |
| 6,105,503 | A | 8/2000 | Baginski | 102/202.5 |
| 6,133,146 | A | 10/2000 | Martinez-Tovar et al. | 438/656 |
| 6,192,802 | B1 | 2/2001 | Baginski | 102/202.2 |
| 6,199,484 | B1 | 3/2001 | Martinez-Tovar et al. | 102/202.4 |
| 6,272,965 | B1 | 8/2001 | Baginski et al. | 86/1.1 |

FOREIGN PATENT DOCUMENTS

| | | |
|---|---|---|
| EP | 0 567 959 A2 | 11/1993 |
| WO | WO 97/42462 | 11/1997 |

ELECTRO-EXPLOSIVE DEVICE WITH LAMINATE BRIDGE

CROSS-REFERENCE TO RELATED APPLICATIONS

This application is a continuation of U.S. patent application Ser. No. 09/656,523, filed Sep. 7, 2000, now abandoned which is incorporated into this application by reference. U.S. patent application Ser. No. 09/656,523 claims the priority under 35 USC 119(e) of Provisional Application No. 60/206,864, filed May 24, 2000.

FIELD OF THE INVENTION

This invention generally relates to an electro-explosive device. More particularly, the invention relates to a device having a laminate bridge that initiates a reaction of relatively high output energy for relatively low input energy.

BACKGROUND TO THE INVENTION

In general, an electro-explosive device (EED) receives electrical energy and initiates a mechanical shock wave and/or an exothermic reaction, such as combustion, deflagration, or detonation. EEDs have been used in both commercial and government applications for a variety of purposes, such as to initiate the inflation of airbags in automobiles or to activate an energy source in an ordnance system.

Prior art EEDs include those that use a bridgewire to ignite an ordnance material. A bridgewire is a thin resistive wire attached between two contacts. The ordnance material surrounds the bridgewire. When current is passed through the bridgewire ohmic heating results. When the bridgewire reaches the ignition temperature of the ordnance material, the ordnance material initiates. Typically, the ordnance material is a primary or pyrotechnic charge which ignites a secondary charge, which in turn ignites a main charge. EEDs that use a bridgewire have significant disadvantages in modem applications. For example, EEDs are subjected to increasing levels of electromagnetic interference (EMI) in many military and civilian applications. High levels of EMI present a serious danger because the EMI may couple electromagnetic energy through a direct or indirect path to an EED, causing it to fire unintentionally. EEDs may also be unintentionally fired by electrostatic discharge (ESD). Conventional devices to protect against unintentional discharge, such as passive filter circuits and EMI shielding, present their own space and weight problems in typical applications.

In order to reduce the sensitivity of an EED to stray signals, the total energy of the firing signal which is necessary to ignite the EED may be increased. As a result, low level stray signals may be conducted through the bridgewire without causing any ignition and only the higher level firing signal would have sufficient energy to ignite the EED. A higher magnitude firing signal, however, is not always desirable. In many applications, such as in automobile airbags, available power is severely limited, making it necessary to provide an EED that has a low firing energy, which may be near the energy level of potential spurious signals such as those from ESD or EMI sources.

One type of EED that alleviates some problems with accidental firing is called a semiconductor bridge, or SCB. An SCB may use less energy than that used by a bridgewire EED for the same no-fire level. For example, the energy required by an SCB may be an order of magnitude less than that required by a bridgewire device with the same no-fire performance. An SCB is a ordnance material initiating device built on a semiconductor substrate. The SCB typically ignites the ordnance material with a hot plasma. When the SCB fires, it creates a high temperature plasma (for example, greater than 4000 K in some cases) with high power density that ignites the ordnance material. The SCB may generate plasma in less than several microseconds as compared to the bridgewire, which may heat to the point of initiation in hundreds of microseconds. The ordnance material ignited by the SCB is typically an adjacent ordnance material or primary explosive that is ignited in a matter of microseconds and in turn ignites an output charge. The excellent heat transfer characteristics of the semiconductor provide a high capacity heat sink for the SCB and thus a relatively high no-fire level. Generally an SCB should be driven by a low impedance voltage source or a capacitive discharge to properly support an avalanche condition that results in plasma creation.

The use of EEDs in automobile airbags and other safety critical applications presents several problems in addition to the prevention of unintentional firing. For example, the reliability of an airbag EED is critical. The airbag EED must fire reliably, and must be manufactured in a way that allows some verification of reliability. Conventional SCBs have some disadvantages that make it difficult to produce verifiably reliable SCB EEDs. For example, SCBs provide a very hot but low energy ignition source that lasts only for microseconds. In typical SCBs the amount of energy output is dependent upon, and is less than, the level of energy input. In cases in which only a very small amount of output energy can be produced, the output energy may not be sufficient to provide reliable ignition.

Reliability of conventional SCB components is also difficult to verify. One reason for this is that in conventional SCBs, the ordnance material and the SCB must be tightly coupled in order to transmit the small energy output of the SCB to the primary ordnance material. That is, at the ordnance material/SCB interface the ordnance material must be in intimate contact with the SCB at all times for SCB firing to reliably ignite the ordnance material. Test methods have been developed to attempt to verify the ordnance material/SCB interface in bridgewire devices but these test methods, generally do not work well for semiconductor devices. For example, it may be possible to verify the presence of the proper amount of ordnance material by weighing, but it is very difficult to verify a proper interface, or intimate contact between the SCB and the ordnance material. Even if a proper interface exists at manufacture, it is difficult to determine whether an interface in a particular device is degraded over time, for example by vibration or shock. Even given a proper interface, without positive retention of the SCB against the ordnance material, the ordnance material may be thrown off by the shock generated by the SCB firing, rather than ignited. Positive retention introduces its own problems, however, including added cost and complexity without resolving verification of continued reliability in the field. In addition, the forces applied to the SCB in positive retention may break the SCB and/or connection bonds in the device.

SUMMARY OF THE INVENTION

A semiconductor bridge (SCB) device on a substrate with a laminate bridge is disclosed. In one embodiment, the SCB device comprises multiple, alternating layers of a thermally and electrically insulating material and a conducting material that is exothermically reactive with the insulating material. The multiple alternating layers form a laminate layer on an insulator on the surface area of the substrate. In one embodiment, the substrate is silicon. In one embodiment, boron is the insulating material and titanium is the conductive material. The laminate layer is typically continuous. In a top view, however, the laminate layer appears as two large sections that substantially cover the surface area of the substrate and are joined by a bridge section. The bridge section has a small cross-sectional area relative to the direction of current flow. The laminate layer is constructed as a series of individual, alternating insulating and reactive layers. The bridge section is reacted when current is passed through contacts on top of the laminate, which initiates the remainder of the laminate. As one layer of the laminate is consumed, another layer is exposed and becomes part of the conductive circuit. The output energy produced is sufficient to ignite ordnance material across a gap.

DETAILED DESCRIPTION OF THE INVENTION

Figure 1:
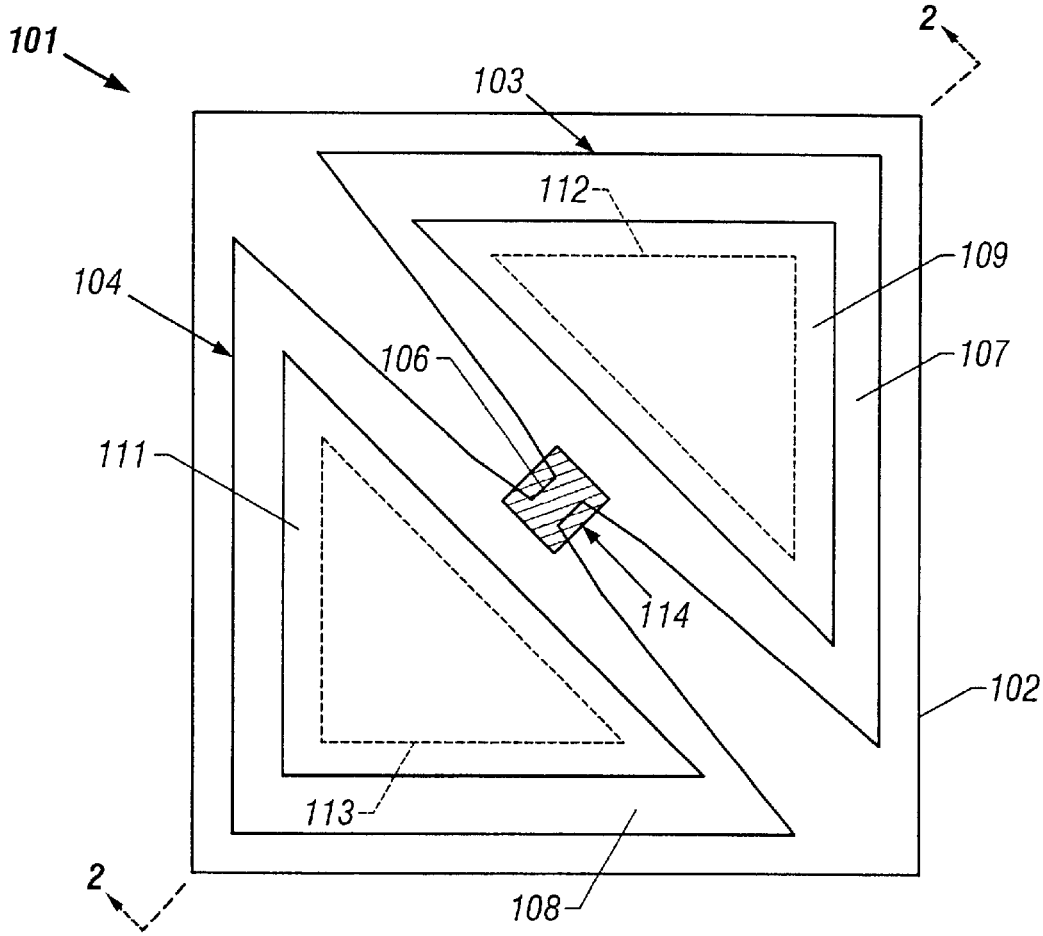
FIG. 1 is a top view of an embodiment of a semiconductor bridge (SCB).
Figure 2:
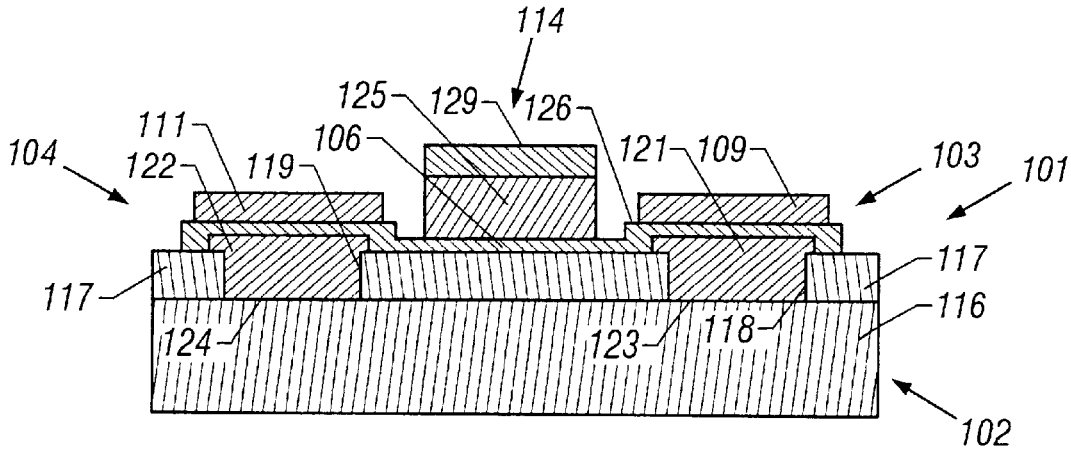
FIG. 2 is a cross-section view of the SCB of FIG. 1.

FIGS. 1 and 2 illustrate one embodiment of an SCB. SCB 101 has integrally formed shunting diodes for protection against ESD events and an enhanced bridge overcoating for increased firing efficiency. Referring first to FIG. 1, the SCB 101 is formed on a silicon wafer substrate 102 that is generally square but may also be any convenient shape. A first generally triangular land 103 is deposited on one side of the substrate 102 and a second generally triangular land 104 is deposited on the opposite side of the substrate 102. The lands 103 and 104 are generally spaced apart and electrically isolated from each other except for a relatively narrow conductive bridge 106 that couples and electrically connects the lands together. In one embodiment, the land 103 is formed partially of a deposited layer of palladium 107, and the land 104 is similarly formed partially of a deposited layer 108 of palladium. In one embodiment, the bridge 106 is also formed of palladium. The lands 103 and 104 and the bridge 106 are further deposited as a single layer of palladium using common integrated circuit etching and deposition techniques.

A first diode 112 is formed beneath and is electrically coupled to the palladium layer 107 of the first land 103 and, similarly, a second diode 113 is formed beneath and electrically coupled to the palladium layer of the second land 104. The formation and structure of these diodes is described in more detail below. A first contact pad, 109 which preferably is formed of composite layers of titanium, nickel, and gold Ti/Ni/Au) is deposited on the palladium layer 107 of the first land 103 and a second similar contact pad 111 is deposited on the palladium layer 108 of the second land 104. The contact pads provide a suitable surface to which electrical leads can be connected to the lands by means of solder, conductive epoxy or the like for supplying firing current to the device. A chemically explosive composite overcoating 114, described in more detail below, is provided on the bridge 106 for enhancing output energy and increasing the dispersion of a firing event.

Referring now to FIG. 2, which is view of cross section A—A of FIG. 1, the substrate 102 is a silicon chip 116 processed in a conventional manner. A layer 117 of silicon dioxide is formed on the surface of the chip and functions as an electrical insulator. Two spaced-apart triangular shaped openings 118 and 119 are etched in the silicon dioxide layer using any appropriate etching technique to expose the surface of the silicon chip. A first layer or pad 121 of aluminum is then deposited over the first etched opening 118 and a second layer or pad 122 of aluminum is deposited over the second etched opening 119. The aluminum pads may be deposited on the chip using any appropriate technique such as, for example, vapor deposition. The first aluminum pad 121 forms a first Schottky barrier junction 123 with the surface of the silicon chip 116 and the second aluminum pad 122 forms a second Schottky barrier junction 124 with the surface of the silicon chip 116. Accordingly, a pair of spaced apart Schottky diodes 112 and 113 are integrally formed with the SCB 101.

The SCB 101 includes a bowtie shaped layer 126 of palladium deposited over the surface of the chip. The layer 126 of palladium is configured to define a first area 107, a second area 108, and a bridge 106 that extends between and electrically couples the larger areas 107 and 108 of the bowtie shaped area 126. The first area 107 of the bowtie covers and is electrically bonded to the first Schottky diode 112 and the second area 108 of the bowtie covers and is electrically bonded to the second Schottky diode 113.

The first contact pad 109 is deposited on the surface of the first area 107 of the bowtie shaped palladium layer and the second contact pad 111 is deposited on the surface of the second area 108 of the bowtie shaped palladium layer. The contact pads 109 and 111, in one embodiment, are composite layers of Ti/Ni/Au. The contact pads 109 and 111 are contacts to which electrical leads may be bonded to the areas 107 and 108 of the bowtie shaped palladium layer 126. The electrical leads supply firing current to the bowtie shaped palladium layer 126.

The deposition, etching, and shaping of the various layers of materials on the surface of the chip 116 is accomplished using conventional integrated circuit fabrication techniques. The choices of metals for the various layers, the shape of the layers, and the relative sizes of the various portions of the layers may be different in different embodiments according to particular requirements. For example, gold or aluminum might be substituted for the palladium of the bowtie and other combinations of appropriate metals could be substituted for the Ti/Ni/Au of the contact pads.

A composite overcoat 114 is deposited atop the bridge 106. As illustrated in FIG. 2, the composite overcoat 114 includes a layer 125 of zirconium deposited on the bridge and a layer 129 of an oxidizer such as, for example, copper oxide or iron oxide, also known as thermite, deposited atop the zirconium layer 128. Copper oxide and iron oxide are formed of molecules with relatively weak chemical bonds and thus tend to donate their oxygen readily in a chemical reaction contributing to high temperature exothermic reactions. The composite overcoat 114 can be deposited on the bridge 106 using any of a variety of known deposition techniques. Furthermore, the composite overcoat need not necessarily be deposited in layers, but could be deposited as a single layer of a mixture of metal and oxidizer. In addition, substitutes may be made for the thermite components, the zirconium and the oxidizer. For example, other weak oxides and metal fuels may be used. Any appropriate chemically explosive overcoating might be substituted in other embodiments.

In operation, the contact pads 109 and 111 are each electrically connected to a respective pair of leads by means, for example, of wirebond, conductive epoxy, or solder. The leads are then coupled to a switchable source of firing potential. When in its dormant state prior to an intentional firing, the SCB is protected from inadvertent firing, such as by ESD events, by the shunt diodes 112 and 113 and the nofire energy of the bridge. More specifically, electric potential induced across the contacts by an ESD event typically is much higher than the turn-on voltage of the diodes formed on the SCB. Thus, the diodes appear to ESD induced potentials as closed circuit shunts and electric current above the shunt threshold is conducted away from the resistive bridge to prevent ohmic heating of the bridge and consequent accidental firing.

In order to fire the bridge of the SCB, a firing potential that is near or above the turn-on voltage of the diodes 112 and 113 is applied to the contacts from a source capable of delivering sufficient firing potential for an appropriate length of time. The firing potential can be provided, for example, by switching a charged capacitor in series with the SCB. The portion of the firing potential that is less than the turn-on voltage of the diodes is applied across the bridge. Current then flows through the bridge causing it to heat rapidly and to vaporize in a relatively high energy plasma reaction.

The heat generated in the palladium bridge by the firing current is directly coupled to the composite overcoat 114 of the SCB. As a consequence, the overcoat is also heated rapidly until the zirconium layer of the overcoat also begins to vaporize in a plasma. This in turn initiates a chemically explosive reaction between the zirconium of the overcoat and the oxidizer layer. The result is a chemical/plasma reaction in the vicinity of the bridge 106 that is substantially more energetic than the plasma explosion of a conductive bridge alone. The explosion generates a plasma filled fireball that projects outwardly from the surface of the SCB. Thus, the composite overcoat 114 greatly enhances the efficiency of the SCB in igniting a ordnance mix packed against its surface while the integral diode shunt protects the bridge from ESD events.

Figure 3:
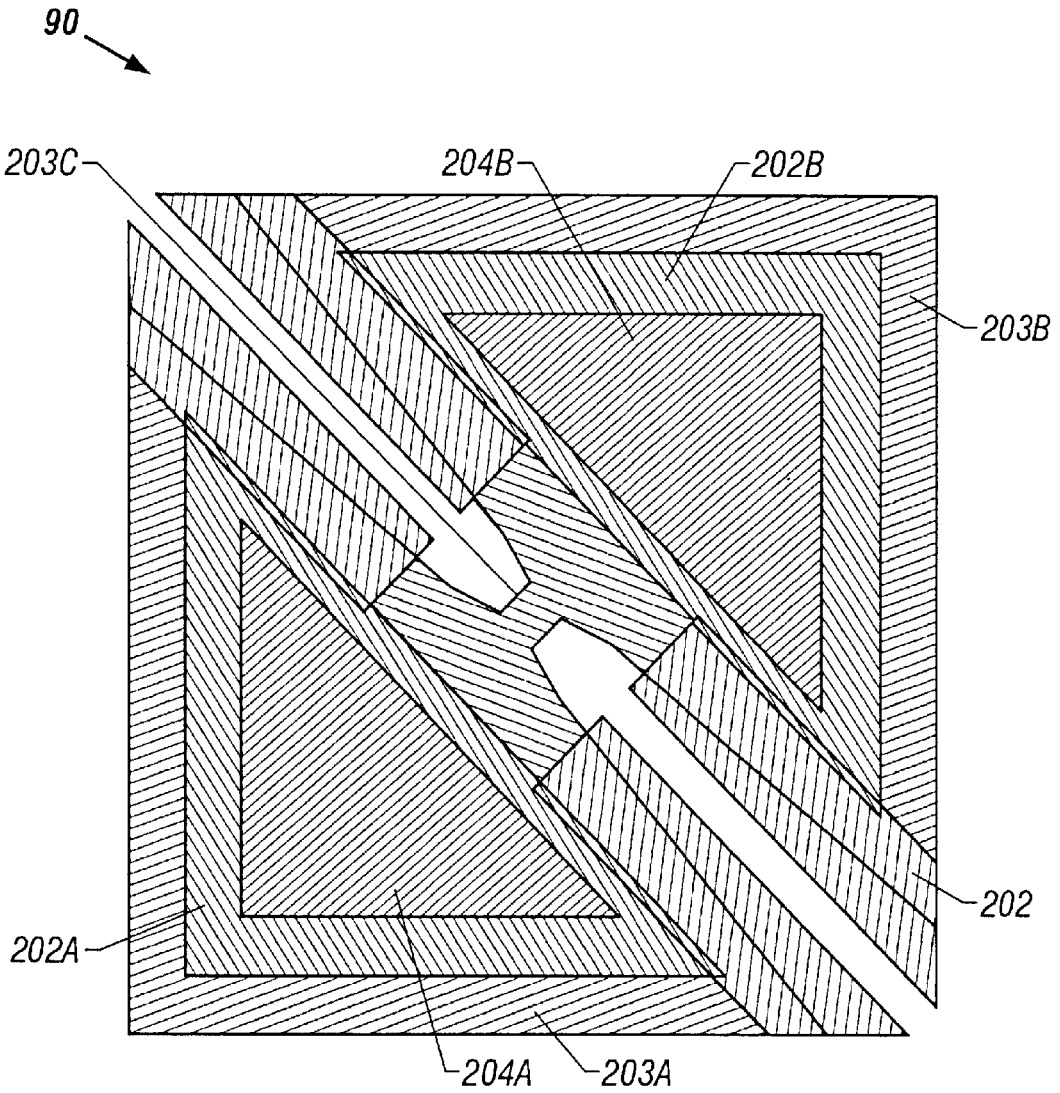
FIG. 3 is a top view of an embodiment of an SCB.
Figure 4:
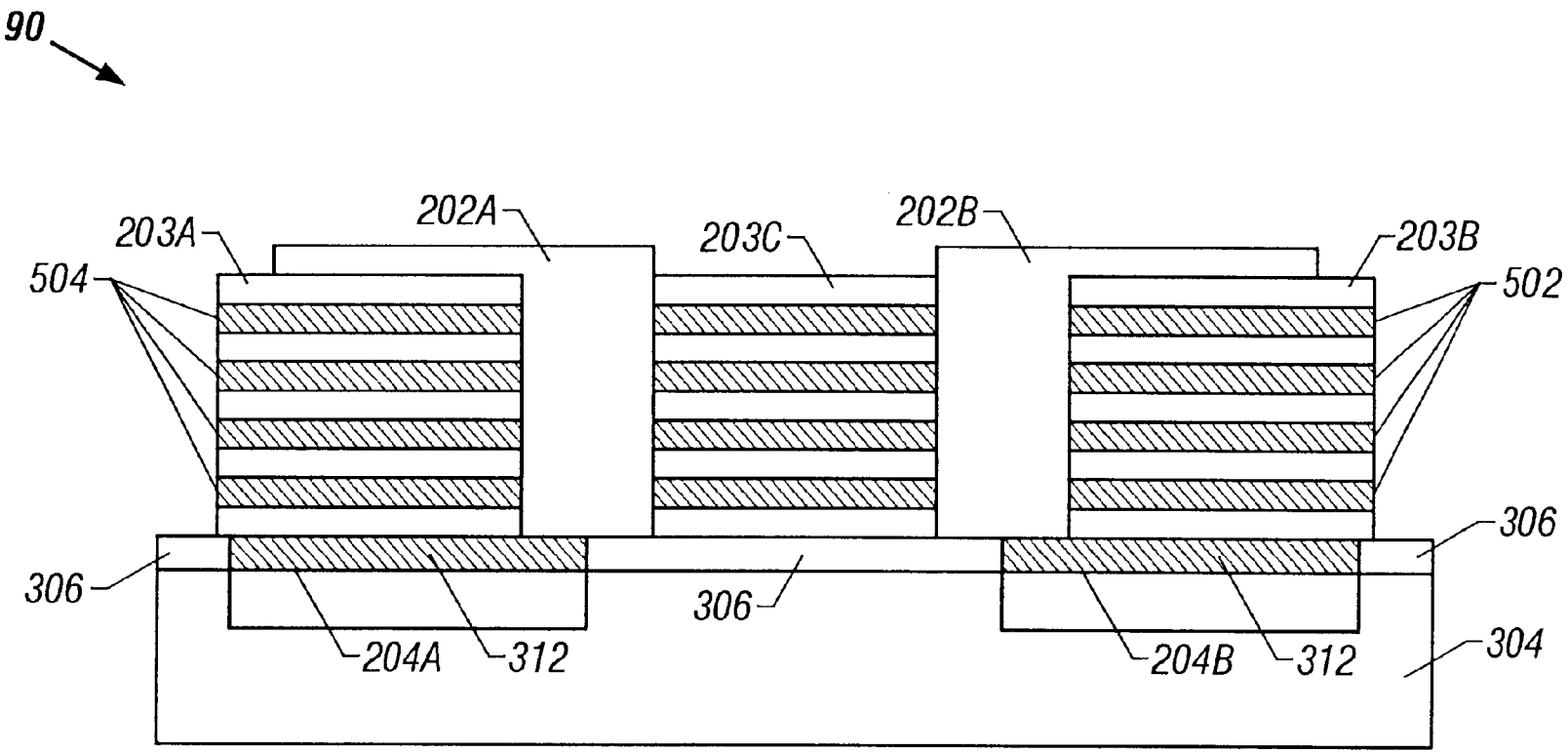
FIG. 4 is a cross-section view of the SCB of FIG. 3.

FIGS. 3 and 4 illustrate another embodiment of an SCB. The SCB 90 includes a greater amount of reactive materials layered over a greater surface area of the SCB as compared to the SCB 101. The SCB 90 has significantly greater energy output upon firing than for example the SCB 101, without appreciably increased energy input. The SCB 90 requires only enough energy to start and minimally sustain a reaction between two reactive materials that explode in plasma projecting outward from the surface of the SCB 90, as further described below. The SCB 90 further includes integrally formed shunting diodes for protection against ESD events.

The sensitivity of the SCB 90 may be adjusted to operate at an input electrical power level required of an application independent of the required energy level to ignite the output ordnance material. The SCB 90 may ignite insensitive materials or materials which require a large amount of heat to ignite.

Significantly, the SCB 90 provides reliable ignition across a gap between the bridge and the ordnance material. This greatly enhances reliability because an intimate interface between the bridge and the ordnance material does not need to be guaranteed for proper operation. Verification of the interface between the bridge and ordnance material is thus not required. It is only necessary to verify, using conventional techniques, that the semiconductor wafer has been correctly processed. The presence of an output charge may be easily verified by weighing or X-ray. This also reduces production costs.

FIG. 3 is a top view of the SCB 90 showing the outlines of a series of material layers set on top of each other as they would appear on a substrate (not shown). FIG. 4 is a simplified diagram of a cross-section of the SCB 90. The SCB 90 includes alternating layers of different materials which are chemically reactive with each other. Typically, one of the materials is a metal. Typically, one of the materials is an insulator, in that it has a high resistivity and low thermal conductivity relative to the metal. In one embodiment, boron is used as the insulator and titanium is used as the metal. In other embodiments, other materials may be used. For example, the metal used may be one or more of aluminum, magnesium, and zirconium, as well as other metals. The insulator used may be one or more of calcium, manganese, and silicon, as well as other insulators.

Alternating layers, or sublayers 502 of titanium and sublayers 504 of boron are built up on a silicon dioxide insulating layer 306. The top layer of the series of layers is a "bridge" layer 203 of titanium that is in contact with the contacts pads 202. The alternating sublayers 502 and 504, and the top bridge layer 203 make up a laminate layer. The layers 502, 504, and 203 are integrally bonded in situ during the semiconductor fabrication process that produces the substrate upon which the layers appear. The resulting structure, including a bridge and fuel, is therefore monolithic. This is in contrast to prior devices which may be fabricated by depositing the fuel as powders after the semiconductor fabrication process, and then mechanically pressing the powder fuel around a bridge.

The top bridge layer 203, as shown in FIG. 3, is a continuous layer of a metal, in this case titanium, that includes two relatively large sections 203A and 203B joined by a bridge section 203C. In other embodiments, the top layer may be boron or some other reactive material. The bridge section 203C has a small cross-sectional area relative to the direction of current flow from the contact pads 202. The cross-sectional area and geometry of the bridge section 203C determine how much energy is required to heat the bridge. The materials used in the bridge, and their geometry and thickness, affect the starting resistance of the bridge section 203C. In various embodiments, the contact pads 202 may be electrically connected to the top bridge layer 203 only, or to the top bridge layer 203 and multiple sublayers 502 and 504. The number of layers electrically connected to the contact pads 202 affects the resistance and heating characteristics of the bridge section 203C. In the case of a single layer in contact with the contact pads 202, the resistance of the layer may be reduced by the addition of a thin layer of a material with a lower resistivity, such as gold. The resistance of the bridge may thus be adjusted to meet specific requirements.

The insulating layer 306 is built on the silicon substrate 304 substantially covers the surface area of the substrate 304. In one embodiment the insulating layer 306 is silicon dioxide. The boron layers 504 and titanium layers 502 and 203 are each approximately 0.25 microns thick. Boron is a relatively poor conductor of heat and has relatively high sheet electrical resistivity compared to titanium. Boron and titanium may be processed with standard semiconductor techniques. The boron sublayers 504 and titanium sublayers 502 are built up under the top bridge layer 203, which includes the bridge section 203C, in a series of layers until the desired thickness is achieved. The thickness of the laminate layer is dependent upon the amount of plasma required to be produced and the desired no-fire level. The thickness of the laminate layer is practically limited only by semiconductor processing technology. A stoichiometry that yields relatively high output energy is one titanium atom per two boron atoms. To achieve this, layer thicknesses may be 250 nm for titanium and 220 nm for boron. A practical number of layers, considering such factors as total processing time, is four layers of titanium and four layers of boron. In most applications, the laminate layer (which includes boron sublayers 504 and titanium sublayers 502 and bridge layer 203) may have a thickness of between two microns and fourteen microns.

The contact pads 202 are titanium/nickel/gold (Ti/Ni/Au) in one embodiment. The contact pads 202 are formed by selectively covering part of the top bridge layer 203 with a standard Ti/Ni/Au coat to form electrical contacts that can be connected, for example, via wire bonds, solder, or conductive epoxy. Titanium has adhesion characteristics that promote bonding to other materials. Nickel provides a solderable contact, if one is desired. Gold is an excellent conductor for providing a conductive path to the layered reactants, and also helps keep the nickel from readily oxidizing. As shown in FIG. 4, the contact pads 202 extend over and through the sublayers 502 and 504 to the aluminum 312. The SCB 90 includes diodes 204 which are integrally formed by the interface of the aluminum 312 with the silicon substrate 304. Two spaced apart triangular shaped openings are etched in the silicon dioxide layer 306 using any appropriate etching technique to expose the surface of the silicon chip 304. Layers or pads 312 of aluminum are then deposited over the etched openings using any appropriate technique such as, for example, vapor deposition. One aluminum pad forms a first barrier junction 204A with the surface of the silicon chip 304 and the other aluminum pad forms a second barrier junction 204B with the surface of the silicon chip 304. The doping of the substrate determines the breakdown voltage of the diode. In applications such as automobile airbag initiators, for example, a breakdown voltage of seven to eight volts provides significant ESD protection. Other application requiring less sensitive bridges may use higher breakdown voltages.

The length and width of the laminate layer formed by layers 203, 502, and 504 extends significantly beyond the length and width of the small bridge section 203C. When current is applied to the small bridge section 203C, the top layer 203 is ohmically heated until it is hot enough to react with the adjoining boron layer. An exothermic reaction results, producing titanium and various titanium compounds, which are expelled as hot plasma. The boron acts as an insulator so that only the plasma arc and the exposed portions of metal layers act as a conductive path. The reaction ceases when the source electrical energy (for example, from a capacitor) is depleted or all of the layers are consumed to a distance at which the plasma arc is extinguished. The output energy is used to heat the ordnance material that is ignited by the plasma. The heat transferred to the sublayers 502 and 504 aids in the reaction instead of being lost to the silicon substrate.

In reactive processes in which the heat released is more than the heat absorbed by the substrate or lost in plasma release, or other mechanisms, the reactive process will continue until all available reactants are consumed. In cases in which the losses exceed the energy output, the reaction will be sustained by the addition of electrical energy via the plasma until the electrical energy is discontinued or the arc length requires more voltage than the source can supply.

Tests of SCB 90 have shown that ignition of ordnance materials occurs across a gap. This eliminates the need to assure contact between the bridge and the primary ordnance material, greatly simplifying manufacture. Additionally, not having to maintain contact between the bridge and the primary ordnance material eliminates many of the reliability problems that may result, such as breaking of wire bonds during powder pressing operations. The SCB 90 can thus be reliably assembled in quantity.

In other embodiments, the area of the SCB 90 covered by layers of reactive material may be varied according to performance requirements. The shape of the area covered may also be varied. For example, multiple layers of boron and titanium, or some other appropriate materials, may be stacked as high as practicable only in the narrow bridge area between the contacts of the SCB.

Figure 5:
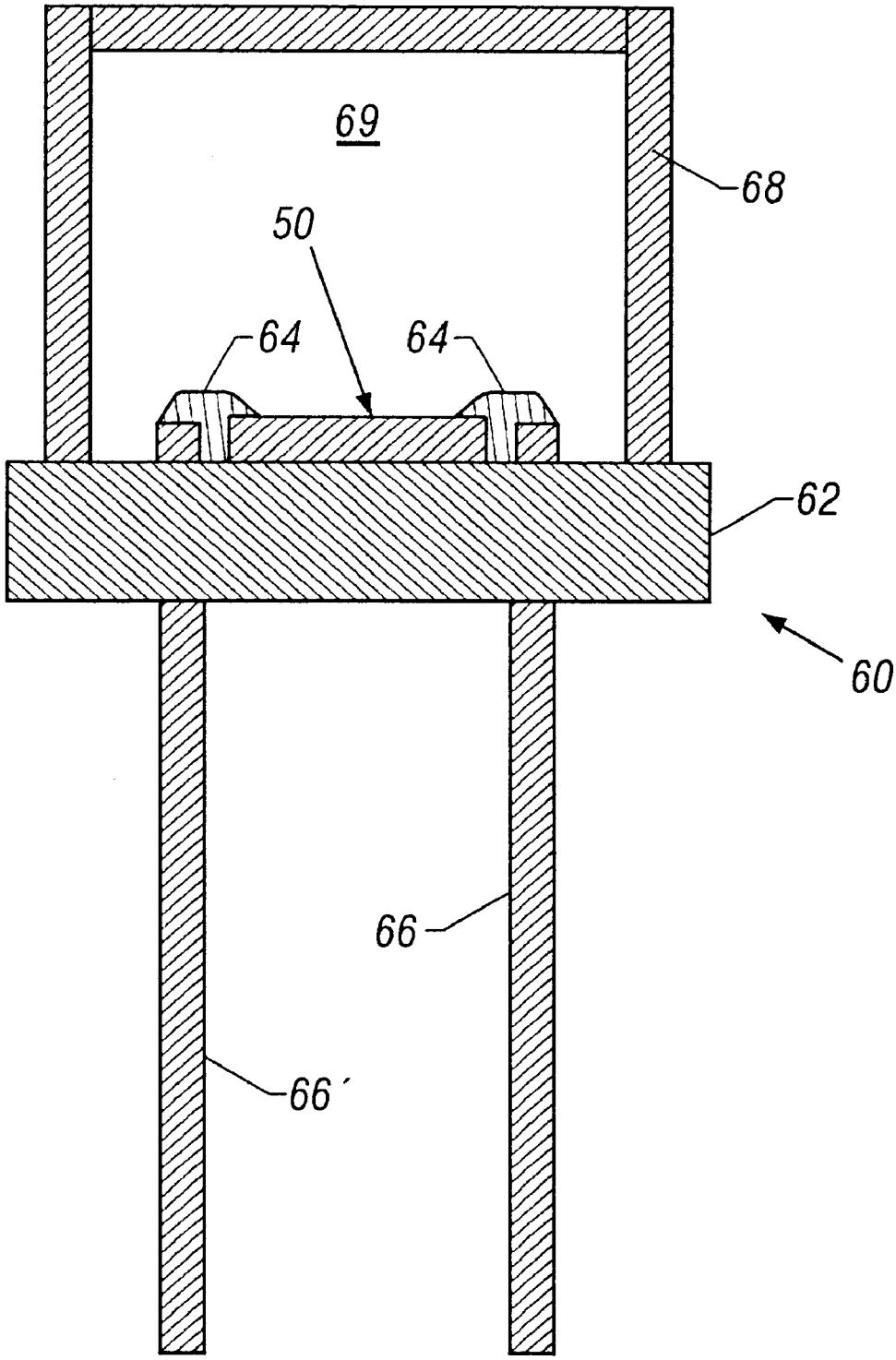
FIG. 5 is a cross-section view of an electro-explosive device (EED).

FIG. 5 is a diagram of a cross-section of an electro-explosive device (EED) 60. An SCB 50 is attached to a header 62, which is formed from a ceramic or metal alloy. The SCB 50 may be similar to the SCB 101 or the SCB 90. The SCB 50 is typically attached with a nonconductive epoxy. An electrical attachment 64, for example conductive epoxy or wire bond, is applied between pins 66 on the header 62, and cap 68 is placed on the header 62 to form an enclosure filled with ordnance material 69.

In operation, a firing signal supplied to the initiator 60 is routed through the pins 66, through the electrical attachment 64, and to the reactive bridge section of the SCB 50, firing the reactive bridge and initiating a reaction that involves all of the reactive material layers on the SCB.

The invention has been described with reference to specific examples. Various modifications may be made by one of ordinary skill in the art without departing from the spirit and scope of the invention as defined in the following claims. For example, alternative material and alternative configurations are within the scope of the invention as claimed.

What is claimed is:

1. An electro-explosive device fabricated on the surface of a substrate, the electro-explosive device comprising:

(a) a laminate layer deposited on the surface of the substrate, the laminate layer comprising a series of alternating layers of a reactive metal and a reactive insulator, the reactive insulator having a resistivity that is high relative to the resistivity of the reactive metal, the laminate layer being configured to define a bridge joining two relatively large sections, (b) comprising, (i) two relatively large sections that substantially cover the surface area of the substrate; and (ii) bridge section joining the two relatively large sections; and (c) a conductive contact pad coupled to each of the at least one of the series of alternating layers, wherein a predetermined current through the at least one conductive contact pad causes the bridge section to initiate a reaction in which the laminate layer is involved.

2. The SCB device of claim 1, wherein the reactive metal is titanium an wherein the reactive insulator is boron.

3. The SCB device of claim 1, wherein each layer of the series of layers is approximately 0.25 microns thick.

4. The SCB device of claim 3, wherein the series of layers has a thickness of between two microns and fourteen microns.

5. The SCB device of claim 1, further comprising an integrated diode formed by an interface of the substrate with another material.

6. The SCB device of claim 1, wherein the at least one conductive contact pad comprises a material selected from one of the following: titanium, nickel, gold, or any mixtures thereof.

7. The SCB device of claim 1, wherein the reactive metal is selected from one of the following: titanium, aluminum, magnesium, or zirconium.

8. The SCB device of claim 1, wherein the reactive insulator is selected from one of the following: boron, silicon, calcium, or manganese.

9. A semiconductor bridge (SCB) device, comprising:

a laminate layer on top of an insulating material, wherein the laminate layer comprises at least a first layer of a first material, at least a second layer of a second material, at least a third layer of the first material, and at least a fourth layer of the second material, and wherein the laminate layer further comprises, two relatively large sections that substantially cover the surface area of the insulating material, and a bridge section joining the two relatively large sections;

for each of the two relatively large sections, at least one conductive contact pad coupled to at least one of the layers of that relatively large section, wherein a predetermined current between at least one conductive contact pad on one of the relatively large sections and at least one conductive pad on the other of the relatively large sections causes the bridge section to initiate a reaction in which the laminate layer is involved.

10. The SCB device of claim 9 wherein as one layer is consumed, another layer is exposed and becomes part of a conductive circuit.

11. The SCB device of claim 9, wherein the first material comprises a reactive insulator and the second material comprises a reactive metal, wherein the reactive insulator has a resistivity that is high relative to a resistivity of the reactive metal, and wherein the reactive metal is in contact with the at least one conductive contact pad.

12. The SCB device of claim 11, wherein the reactive metal is titanium an wherein the reactive insulator is boron.

13. The SCB device of claim 9, wherein each layer of the series of layers is approximately 0.25 microns thick.

14. The SCB device of claim 13, wherein the series of layers has a thickness of between two microns and fourteen microns.

15. The SCB device of claim 9, further comprising an integrated diode formed by an interface of the insulating material with another material.

16. The SCB device of claim 9, wherein the at least one conductive contact pad comprises a material selected from one of the following: titanium, nickel, gold, or any mixtures thereof.

17. The SCB device of claim 9, wherein the reactive metal is selected from one of the following: titanium, aluminum, magnesium, or zirconium.

18. The SCB device of claim 9, wherein the reactive insulator is selected from one of the following: boron or silicon.

19. A semiconductor bridge (SCB) device, comprising:

a laminate layer comprising:

a plurality of first sublayers, each comprising a first material;

a plurality of second sublayers, each comprising a second material;

a plurality of second sublayers, each comprising a second material; and wherein the laminate layer comprises, two relatively large sections that substantially cover the surface area of the insulating material, and a bridge section joining the two relatively large sections;

for each of the two relatively large sections, at least one conductive contact pad coupled to at least one of the sublayers of that relatively large section.

20. A semiconductor bridge (SCB) device, comprising:

a laminate layer on top of an insulating material, wherein the laminate layer comprises a series of layers wherein the layers comprise at least two layers of a first reactive material and at least two layers of a second reactive material, and wherein the laminate layer comprises, two relatively large sections that substantially cover the surface area of the insulating material, and a bridge section joining the two relatively large sections;

for each of the two relatively large sections, at least one conductive contact pad coupled to at least one of the series of layers of that relatively large section, wherein the contact pad extends vertically to be in contact with a plurality of layers of the laminate.

21. The SCB device of claim 19 wherein as one layer is consumed, another layer is exposed and becomes part of a conductive circuit.

22. The SCB device of claim 19, wherein each sublayer of the plurality of sublayers is approximately 0.25 microns thick.

23. The SCB device of claim 19, wherein the plurality of sublayers each has a thickness of between two microns and fourteen microns.

24. The SCB device of claim 19, further comprising an integrated diode formed by an interface of the insulating material with another material.

25. The SCB device of claim 19, wherein the at least one conductive contact pad comprises a material selected from one of the following: titanium, nickel, gold, or any mixtures thereof.

26. The SCB device of claim 19, wherein the second material is a reactive metal is selected from one of the following: titanium, aluminum, magnesium, or zirconium.

27. The SCB device of claim 19, wherein the first material is a reactive insulator is from one of the following: boron, silicon, calcium, or manganese.

28. The SCB device of claim 20 wherein as one layer is consumed, another layer is exposed and becomes part of a conductive circuit.

29. The SCB device of claim 20, wherein the second reactive material is titanium an wherein the first reactive material is boron.

30. The SCB device of claim 20, wherein each layer of the series of layers is approximately 0.25 microns thick.

31. The SCB device of claim 20, wherein the series of layers has a thickness of between two microns and fourteen microns.

32. The SCB device of claim 20, further comprising an integrated diode formed by an interface of the insulating material with another material.

33. The SCB device of claim 20, wherein the at least one conductive contact pad comprises a material selected from one of the following: titanium, nickel, gold, or any mixtures thereof.

34. The SCB device of claim 20, wherein the second reactive metal is selected from one of the following: titanium, aluminum, magnesium, or zirconium.

35. The SCB device of claim 20, wherein the first reactive layer is selected from one of the following: boron, silicon, calcium, or manganese.

36. The SCB device of claim 1, wherein the reactive metal is in contact with the at least one conductive contact pad.

* * * * *